US008155357B2

(12) United States Patent
Kim et al.

(10) Patent No.: US 8,155,357 B2
(45) Date of Patent: Apr. 10, 2012

(54) APPARATUS AND METHOD OF REPRODUCING A 7.1 CHANNEL SOUND

(75) Inventors: Sun-min Kim, Suwon-si (KR); Seong-cheol Jang, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1616 days.

(21) Appl. No.: 11/075,915

(22) Filed: Mar. 10, 2005

(65) Prior Publication Data

US 2005/0281408 A1 Dec. 22, 2005

Related U.S. Application Data

(60) Provisional application No. 60/579,658, filed on Jun. 16, 2004.

(30) Foreign Application Priority Data

Jun. 17, 2004 (KR) ..... 10-2004-0045051

(51) Int. Cl.
*H04R 5/02* (2006.01)

(52) U.S. Cl. ..... 381/310; 381/20; 381/17

(58) Field of Classification Search ..... 381/22, 381/23, 27, 1, 17, 18, 20, 21, 310, 300
See application file for complete search history.

(56) References Cited

U.S. PATENT DOCUMENTS 5,400,433 A * 3/1995 Davis et al. ..... 704/220
5,579,396 A * 11/1996 Iida et al. ..... 381/18
5,764,777 A * 6/1998 Goldfarb ..... 381/27
5,862,227 A * 1/1999 Orduna-Bustamante et al. ..... 381/17
5,870,484 A * 2/1999 Greenberger ..... 381/300
6,470,087 B1 * 10/2002 Heo et al. ..... 381/17
2004/0264717 A1 12/2004 Fujita et al.
2005/0129249 A1 * 6/2005 Chabanne ..... 381/17

FOREIGN PATENT DOCUMENTS

| | | |
|---|---|---|
| JP | 2004-056418 | 2/2004 |
| NL | 1014777 | 10/2002 |
| WO | WO 99/49574 | 9/1999 |
| WO | WO 03/053099 | 6/2003 |

OTHER PUBLICATIONS

Korean Office Action dated Feb. 10, 2006 of Korean Patent Application No. 2004-0045051.
Dutch Search Report dated Mar. 26, 2007 issued in NL 1029251.

* cited by examiner

*Primary Examiner* — Xu Mei
(74) *Attorney, Agent, or Firm* — Stanzione & Kim, LLP

(57) ABSTRACT

A method and an apparatus to reproduce a 7.1 channel encoded sound through a 5.1 channel speaker system are provided. The apparatus includes a decoder to separate a 7.1 channel audio bitstream into 8 channel audio signals, a signal corrector to correct characteristics of a left channel audio signal, a right channel audio signal, a center channel audio signal, left and right surround channel audio signals, and a low frequency effect channel audio signal out of the 8 channel audio signals, a back surround filter to form virtual speakers for a left back channel audio signal and a right back channel audio signal at arbitrary locations using head related transfer functions measured at predetermined locations around a listener and to cancel crosstalk between the virtual speakers, and an adder to add the right surround channel audio signal output by the signal corrector to the right back channel audio signal output by the back surround filter and to add the left surround channel audio signal output by the signal corrector to the left back channel audio signal output by the back surround filter.

26 Claims, 3 Drawing Sheets

APPARATUS AND METHOD OF REPRODUCING A 7.1 CHANNEL SOUND

CROSS-REFERENCE TO RELATED APPLICATIONS

This application claims priority from U.S. Provisional Application No. 60/579,658, filed on Jun. 16, 2004, and Korean Patent Application No. 2004-45051, filed on Jun. 17, 2004 in the Korean Intellectual Property Office, the disclosure of which is incorporated herein in its entirety by reference.

BACKGROUND OF THE INVENTION

1. Field of the Invention

The present general inventive concept relates to an audio reproduction apparatus, and more particularly, to an apparatus and method of reproducing a 7.1 channel sound, by which a sound encoded using 7.1 channels is reproduced, through a 5.1 channel speaker system.

2. Description of the Related Art

An audio reproduction apparatus typically provides a surround sound effect similar to a 5.1 channel system using only two speakers.

Technology related to the audio reproduction apparatus is disclosed in WO 99/49574 (PCT/AU99/00002 filed Jan. 6, 1999 entitled AUDIO SIGNAL PROCESSING METHOD AND APPARATUS).

Referring to FIG. 1, technology relating to a conventional audio reproduction apparatus denotes a down mixing technique in which a 5.1-channel surround sound is formed using only a 2-channel speaker. The down mixing technique comprises convolving input signals with impulse responses using head related transfer functions (HRTFs) to form two groups of convolved signals corresponding to two channels (i.e., a left channel 10 and a right channel 11) and adding the two groups of convolved signals that correspond to the two channels.

As illustrated in FIG. 1, input signals 2 including a left-front channel input signal, a right-front channel input signal, a center-front channel input signal, a left-surround channel input signal, a right-surround channel input signal, and a low frequency effect (LFE) channel input signal are convolved with corresponding impulse responses, respectively. Convolved signals are divided into a left channel and a right channel and are then output through a 2 channel speaker. Consequently, a 2 channel output signal is reproduced, such that the conventional audio reproducing apparatus forms a surround sound effect during which a sound is reproduced through a left speaker, a right speaker, a center speaker, a left-surround speaker, and a right surround speaker that are located around a listener.

However, since speakers in the conventional audio reproducing apparatus are typically located in front of the listener, the conventional audio reproducing system has a difficulty in accurately forming a virtual sound at a rear side of the listener.

SUMMARY OF THE INVENTION

The present general inventive concept provides an apparatus and a method of reproducing a 7.1 channel sound, in which 5.1 channel sounds of 7.1 channel sounds are output through corresponding speakers, and left and right back channel sounds are reproduced through virtual speakers using head related transfer functions (HRTFs).

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing an audio reproducing apparatus including a decoder to separate a 7.1 channel audio bitstream into 8 channel audio signals, a signal corrector to correct characteristics of a left channel audio signal, a right channel audio signal, a center channel audio signal, left and right surround channel audio signals, and a low frequency effect channel audio signal of the 8 channel audio signals, a back surround filter to form virtual speakers for a left back channel audio signal and a right back channel audio signal at arbitrary locations using head related transfer functions measured at predetermined locations around a listener and to cancel crosstalk between the virtual speakers, and an adder to add the right surround channel audio signal output by the signal corrector to the right back channel audio signal output by the back surround filter and to add the left surround channel audio signal output by the signal corrector to the left back channel audio signal output by the back surround filter.

The foregoing and/or other aspects and advantages of the present general inventive concept may also be achieved by providing an audio reproducing method including separating an audio bitstream into a plurality of channel audio signals, correcting characteristics of a first set of channel audio signals, forming virtual speakers for a second set of channel audio signals other than the first set of corrected channel audio signals at arbitrary locations using head related transfer functions measured at predetermined locations around a listener and canceling crosstalk between the virtual speakers, and mixing the first set of corrected channel audio signals and the second set of crosstalk-cancelled channel audio signals.

The foregoing and/or other aspects and advantages of the present general inventive concept may also be achieved by providing an audio reproducing system to reproduce a sound of 7.1 channels through 5.1 channel speakers. The audio reproducing system includes a back surround filter to form a virtual speaker for a left back channel and a right back channel of the 7.1 channels, a correction filter to correct an output timing and an output level of each of the 7.1 channels except for the left back channel and the right back channel, and an adder to add the left back channel output by the back surround filter to a left surround channel output by the correction filter and to add the right back channel output by the back surround filter to a right surround channel output by the correction filter. The back surround filter can be obtained using the following equation:

$$\begin{bmatrix} K_{11}(z) & K_{12}(z) \\ K_{21}(z) & K_{22}(z) \end{bmatrix} = \begin{bmatrix} C_{11}(z) & C_{12}(z) \\ C_{21}(z) & C_{22}(z) \end{bmatrix} \begin{bmatrix} B_{11}(z) & B_{12}(z) \\ B_{21}(z) & B_{22}(z) \end{bmatrix}$$

wherein K(z) denotes a back surround filter matrix, C(z) denotes a crosstalk filter matrix, and B(z) denotes a binaural synthesis filter matrix.

$B_{11}$, and $B_{21}$ of the binaural synthesis filter matrix B(z) can be obtained using head related transfer functions between a speaker located between 135° and 150° on a left side of a listener and left and right ears of a dummy head, respectively. $B_{12}$ and $B_{22}$ of the binaural synthesis filter matrix B(z) are obtained using head related transfer functions between a speaker located between 135° and 150° on a right side of the listener and the left and right ears of the dummy head, respectively.

The crosstalk cancellation filter matrix C(z) can be calculated using the following equation:

$$\begin{bmatrix} C_{11}(z) & C_{12}(z) \\ C_{21}(z) & C_{22}(z) \end{bmatrix} = \begin{bmatrix} H_{11}(z) & H_{12}(z) \\ H_{21}(z) & H_{22}(z) \end{bmatrix}^{-1}$$

wherein $H_{11}$ and $H_{21}$ denote head related transfer functions between a speaker located between 90° and 110° on the left side of the listener and the left and right ears of the dummy head, respectively, and $H_{12}$ and $H_{22}$ denote head related transfer functions between a speaker located between 90° and 110° on the right side of the listener and the left and right ears of the dummy head, respectively.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
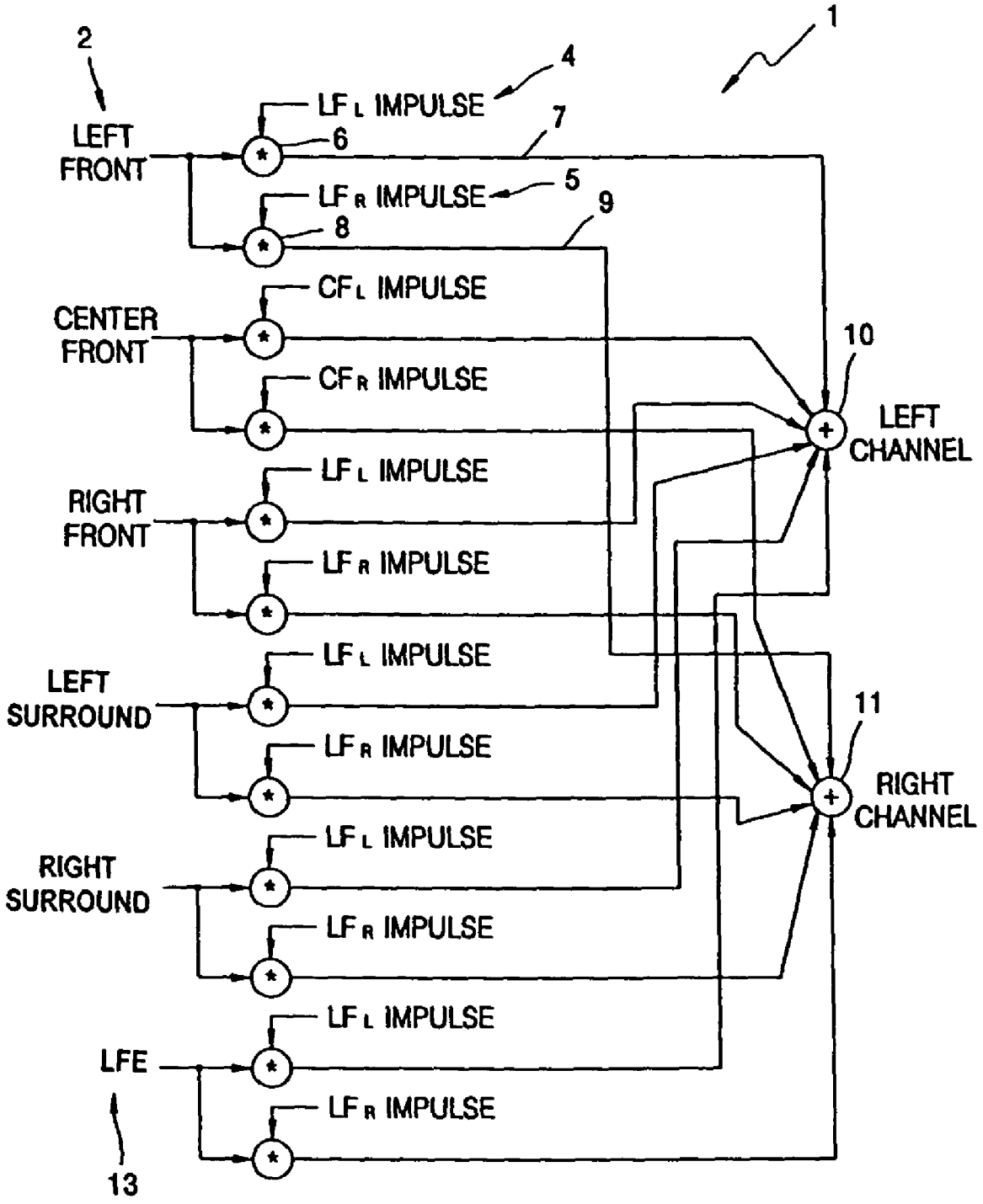
FIG. 1 (PRIOR ART)
FIG. 1 is a block diagram illustrating a conventional audio reproduction apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
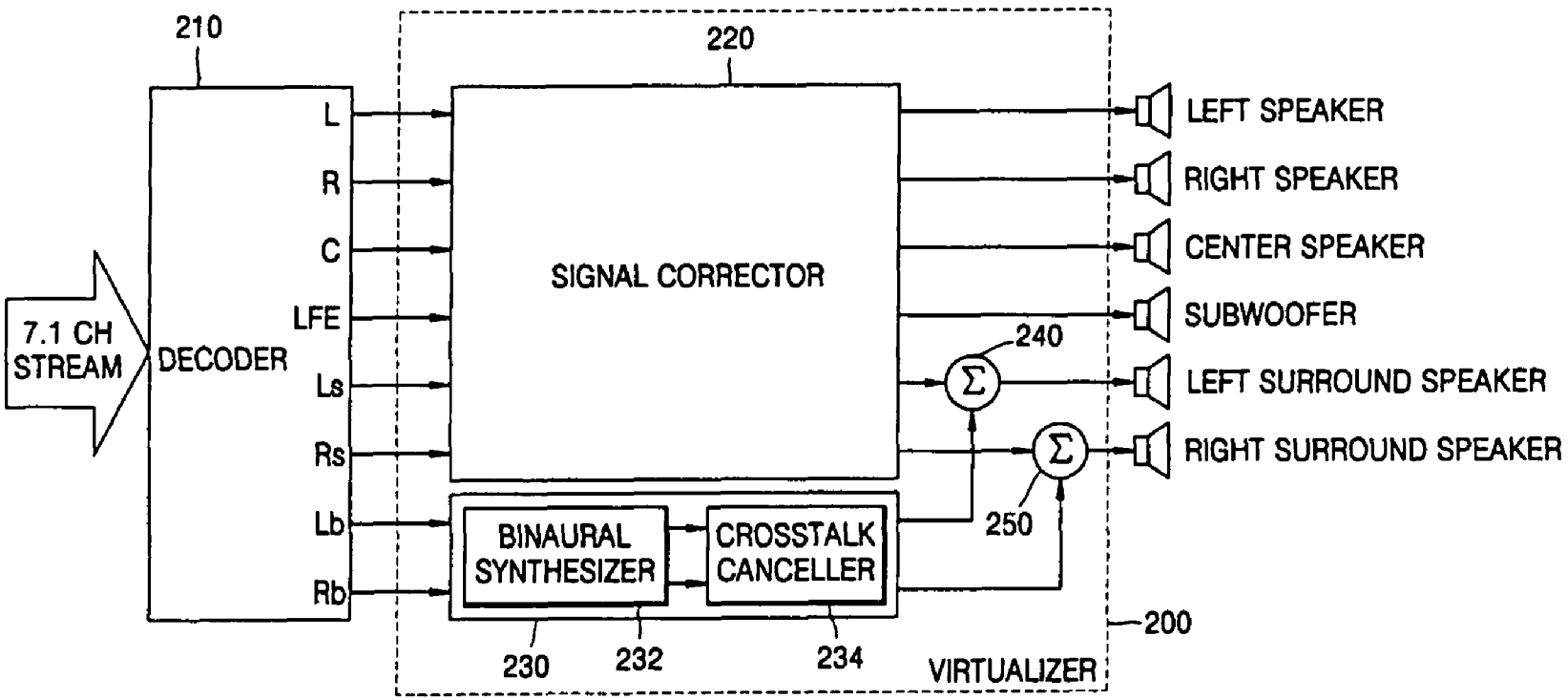
FIG. 2 is a block diagram illustrating a 7.1 channel audio reproducing apparatus according to an embodiment of the present general inventive concept.

Referring to FIG. 2, a 7.1 channel audio reproducing apparatus according to an embodiment of the present general inventive concept includes a decoder 210, a virtualizer 200, and six speakers including a left speaker, a right speaker, a center speaker, a subwoofer, a left surround speaker, and a right surround speaker. The virtualizer 200 includes a signal corrector 220 and a back surround filter 230. The back surround filter 230 includes a binaural synthesizer 232 and a crosstalk canceller 234. The signal corrector 220 corrects a timing delay and an output level of a left channel signal L, a right channel signal R, a center channel signal C, a left surround channel signal Ls, a right surround channel signal Rs, and a low frequency effect LFE channel signal of 7.1 channel signals, and resultant channel signals are reproduced through corresponding 5.1 channel speakers, for example, the left, right, center, left and right surround speakers, and the subwoofer. The back surround filter 230 filters a left back channel signal Lb and a right back channel signal Rb of the 7.1 channel signals, and resultant signals are reproduced through the left surround speaker and the right surround speaker, respectively.

Referring to FIG. 2, the decoder 210 separates a 7.1 channel audio bitstream received from a DVD player into 8 channel signals, which include the left channel signal L, the right channel signal R, the center channel signal C, the left surround channel signal Ls, the right surround channel signal Rs, the low frequency effect LFE channel signal, the left back channel signal Lb, and the right back channel signal Rb.

The back surround filter 230 forms a virtual left back speaker and a virtual right back speaker for the left and right back channel signals Lb and Rb, respectively, output by the decoder 210. The back surround filter 230 includes a binaural synthesizer 232 to form the virtual speakers for the left and right back channel signals Lb and Rb of the decoder 210 based on head related transfer functions (HRTFs) measured at predetermined locations around a listener. The back surround filter 230 further includes the crosstalk canceller 234 to cancel a crosstalk between the virtual speakers. The back surround filter 230 also produces a back surround filter matrix K(z) by convolving a binaural synthesis matrix and a crosstalk canceller matrix.

The signal corrector 220 corrects output timings and the output levels of the left channel signal L, the right channel signal R, the center channel signal C, the left surround channel signal Ls, the right surround channel signal Rs, and the LFE channel signal.

If sounds corresponding to the left back channel signal Lb and the right back channel signal Rb of 7.1 channel sounds pass through a back surround filter matrix and are then reproduced through the left and right surround speakers, and the other 5.1 channel sounds (i.e., a left channel sound L, a right channel sound R, a center channel sound C, a low frequency effect channel sound LFE, a left surround channel sound Ls, and a right surround channel sound Rs) are directly reproduced through corresponding 5.1 channel speakers without passing through any device, an unnatural sound may be produced due to a difference in the output timing and the output level between the back channel sounds (i.e., sounds corresponding to the left back channel signal Lb and the right back channel signal Rb) passed through the back surround filter matrix, and the 5.1 channel sounds. Accordingly, the signal corrector 220 corrects the output timings and the output levels of the 5.1 channel sounds according to characteristics of the back surround filter matrix of the back surround filter 230. Since the signal corrector 220 corrects the characteristics of the back surround filter matrix, the signal corrector 220 corrects the output timings and the output levels of the 5.1 channel sounds uniformly instead of individually according to the type of channel. In other words, each channel signal is convolved by an output timing and output level filter matrix G(z). The output timing and output level filter matrix G(z) is given by Equation 1:

$$G(z)=az^{-b} \tag{1}$$

wherein "a" denotes a value relating to an output level of a signal, which is determined through an RMS (root mean square) power comparison between input and output signals of the back surround filter matrix, and "b" denotes a timing delay value of the back surround filter matrix, which is obtained from an impulse response or phase characteristics of the back surround filter matrix, or through hearing experiments.

First and second adders 240 and 250 add the left and right surround channel signals Ls and Rs, respectively, produced by the signal corrector 220 to virtual left and right back channel signals Lb and Rb, respectively, produced by the back surround filter 230. In other words, the 7.1 channel sound is down mixed to the 5.1 channel sound while passing through the filter matrix G(z) for the signal corrector 220 and a filter matrix K(z) for the back surround filter 230. The left, right, center, and LFE channel signals L, R, C, and LFE are passed through the matrix G(z) for the signal corrector 220 and are reproduced through the left speaker, the right speaker, the center speaker, and the subwoofer, respectively. The left and right surround channel signals Ls and Rs pass through the matrix G(z) for the signal corrector 220 to be converted into two left and right output signals. The left and right back channel signals Lb and Rb pass through the matrix K(z) for the back surround filter 230 to be converted into two left and right output signals. Finally, the first adder 240 adds the left surround channel signal Ls to the left back channel signal Lb and outputs a result of the addition to the left surround speaker. The second adder 250 adds the right surround channel signal Rs to the right back channel signal Rb and outputs a result of the addition to the right surround speaker. In other words, the 5.1 channel sound signals pass by the first and second adders 240 and 250 and are then reproduced through the corresponding 5.1 channel speakers. The 7.1 channel sound is down mixed to the 5.1 channel sound, and the 5.1 channel sound is reproduced through the 5.1 channel speakers.

Figure 3:
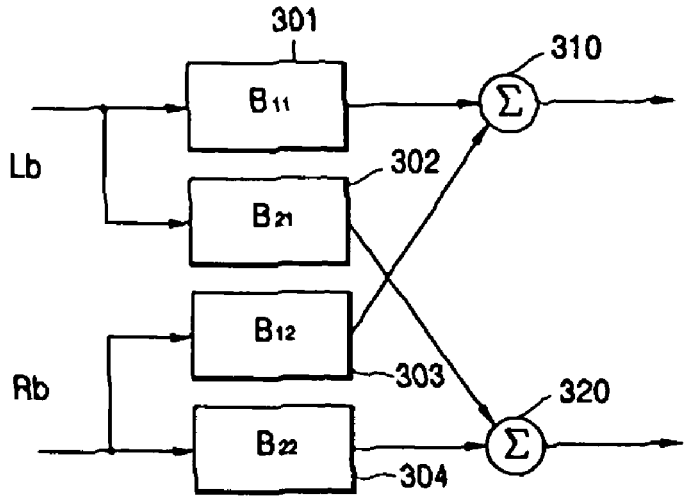
FIG. 3 is a block diagram illustrating a binaural synthesizer of the 7.1 channel audio reproducing apparatus of FIG. 2.

FIG. 3 is a block diagram illustrating the binaural synthesizer 232 of FIG. 2, including first, second, third, and fourth convolution units 301, 302, 303, and 304 and first and second summing units 310 and 320.

An acoustic transfer function between a speaker and an eardrum is referred to as a head related transfer function (HRTF), which is represented by a binaural synthesis matrix having coefficients $B_{11}$, $B_{12}$, $B_{21}$, and $B_{22}$. The HRTF contains information representing characteristics of a space into which a sound is transferred, including a timing difference between right and left ears, a level difference between the right and left ears, and shapes of right and left pinnas of the right and left ears, respectively. Particularly, the HRTF includes information about the pinnas that critically affects localizations of upper and lower sound images. A sound image refers to a location where a listener perceives that the sound is coming from. The information about the pinnas can be obtained through measurements, because modeling the pinnas may be difficult. Hence, an HRTF is usually measured using a dummy head.

A back surround speaker is generally localized between 135° and 150°. To localize a virtual speaker between 135° and 150°, an HRTF is measured between 135° and 150° on left and right sides with respect to a center of a listener. A dummy head having left and right ears can be used to represent the listener to measure the HRTFs. The HRTFs between a speaker located between 135° and 150° on the left side of the dummy head and the left and right ears of the dummy head are referred to as $B_{11}$ and $B_{21}$, respectively. The HRTFs between a speaker located between 135° and 150° on the right side of the dummy head and the left and right ears of the dummy head are referred to as $B_{12}$ and $B_{22}$, respectively. As illustrated in FIG. 3, a first convolution unit 301 convolves a left back channel signal Lb with the HRTF $B_{11}$ (the HRTF corresponding to the left ear of the dummy head when the speaker is located between 135° and 150° on the left side of the dummy head), a second convolution unit 302 convolves the left back channel signal Lb with the HRTF $B_{21}$ (the HRTF corresponding to the right ear of the dummy head when the speaker is located between 135° and 150° on the left side of the dummy head), a third convolution unit 303 convolves a right back channel signal Rb with the HRTF $B_{12}$ (the HRTF corresponding to the left ear of the dummy head when the speaker is located between 135° and 150° on the right side of the dummy head), and a fourth convolution unit 304 convolves the right back channel signal Rb with the HRTF $B_{22}$ (the HRTF corresponding to the right ear of the dummy head when the speaker is located between 135° and 150° on the right side of the dummy head). The first summing unit 310 adds values of the convolutions provided by the first and third convolution units 301 and 303 to form a first virtual left channel signal. The second summing unit 320 adds values of the convolutions provided by the second and fourth convolution units 302 and 304 to form a second virtual right channel signal. Consequently, two signals passed through the HRTFs for the left and right ears, respectively, are added together and output through the virtual left back speaker, and the other two signals passed through the HRTFs for the left and right ears, respectively, are added together and output through the virtual right back speaker.

Thus, when the listener hears a binaural-synthesized 2 channel signal through a headphone, it seems to the listener that the sound image is located between 135° and 150° on the left and right sides with respect to the center of the listener.

Figure 4:
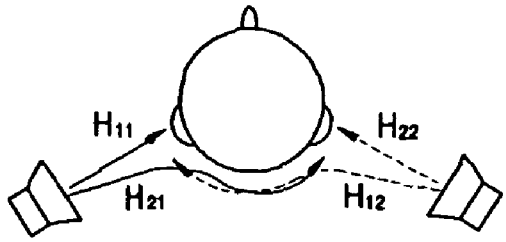
FIG. 4 is a conceptual diagram illustrating a crosstalk canceller of the 7.1 channel audio reproducing apparatus of FIG. 2.

FIG. 4 is a conceptual diagram illustrating the crosstalk canceller 234 of FIG. 2.

Binaural synthesis provides the greatest performance when a sound is reproduced through a headphone. As illustrated in FIG. 4, when a sound is reproduced through two virtual speakers, crosstalk between the two speakers and two ears of a listener occurs, thereby degrading a sense of localization of a virtual sound. In other words, although a sound of a left channel should only be heard in a left ear, and a sound of a right channel should only be heard in a right ear, some of the left channel sound is nevertheless heard by the right ear and some of the right channel sound is nevertheless heard by the left ear due to the crosstalk between the two channels, thus causing the degradation of the sense of localization. Hence, the crosstalk must be removed to prevent the right (or left) ear from hearing a signal reproduced through a left (or right) speaker.

Referring to FIG. 4, since a surround speaker is usually disposed between 90° and 110° on each of the left and right sides with respect to the center of the listener, HRTFs between 90° and 110° on the left and right sides are first measured to design the crosstalk canceller 234. The HRTFs between a speaker located between 90° and 110° on the left side of the listener and left and right ears of a dummy head are referred to as $H_{11}$ and $H_{21}$. The HRTFs between the speaker located between 90° and 110° on the right side of the listener and the left and right ears of the dummy head are referred to as $H_{12}$ and $H_{22}$. A crosstalk cancellation matrix C(z) is designed by inverting a matrix of the HRTFs $H_{11}$, $H_{12}$, $H_{21}$ and $H_{22}$ as in Equation 2:

$$\begin{bmatrix} C_{11}(z) & C_{12}(z) \\ C_{21}(z) & C_{22}(z) \end{bmatrix} = \begin{bmatrix} H_{11}(z) & H_{12}(z) \\ H_{21}(z) & H_{22}(z) \end{bmatrix}^{-1} \tag{2}$$

Figure 5:
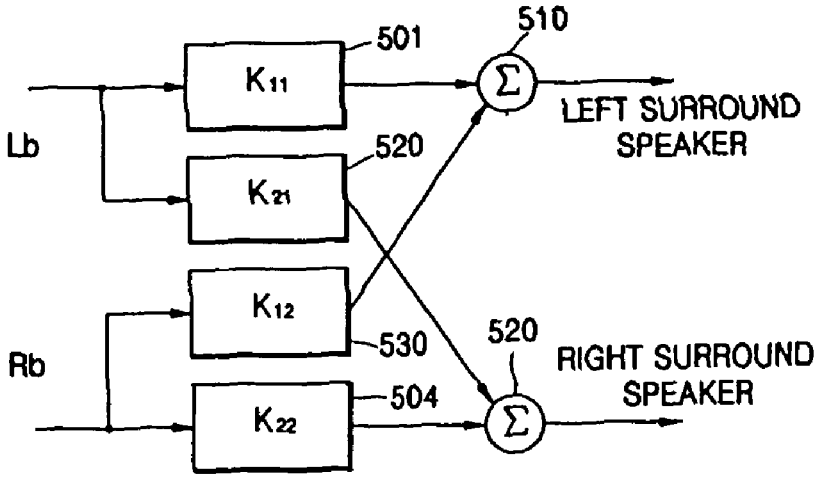
FIG. 5 is a block diagram illustrating a back surround filter of the 7.1 channel audio reproducing apparatus of FIG. 2.

FIG. 5 is a block diagram illustrating the back surround filter 230 of FIG. 2. The binaural synthesizer 232 is a filter matrix that localizes virtual speakers at locations of left and right back speakers. The crosstalk canceller 234 is a filter matrix that removes crosstalk between the two speakers and two ears. Hence, the filter matrix K(z) for the back surround filter 230, that is, a back surround filter matrix K(z), is obtained by multiplexing the binaural synthesis matrix B(z) and the crosstalk cancellation matrix C(z) as in Equation 3:

$$\begin{bmatrix} K_{11}(z) & K_{12}(z) \\ K_{21}(z) & K_{22}(z) \end{bmatrix} = \begin{bmatrix} C_{11}(z) & C_{12}(z) \\ C_{21}(z) & C_{22}(z) \end{bmatrix} \begin{bmatrix} B_{11}(z) & B_{12}(z) \\ B_{21}(z) & B_{22}(z) \end{bmatrix} \quad (3)$$

As illustrated in FIG. 5, the left and right back channel signals Lb and Rb are convolved with the back surround filter matrix K(z) to obtain signals of two channels. More specifically, a first convolution unit 501 convolves the left back channel signal Lb with a filter coefficient $K_{11}$, a second convolution unit 502 convolves the left back channel signal Lb with a filter coefficient $K_{21}$, a third convolution unit 503 convolves the right back channel signal Rb with a filter coefficient $K_{12}$, and a fourth convolution unit 504 convolves the right back channel signal Rb with a filter coefficient $K_{22}$. A first summing unit 510 adds together values of the convolutions provided by the first and third convolution units 501 and 503 to form a virtual left back speaker. A second summing unit 520 adds values of the convolutions provided by the second and fourth convolution units 502 and 504 to form a virtual right back speaker.

When the signals of the two channels are reproduced through the left and right surround speakers, an effect where the listener perceives that left and right back channel sounds originate from the rear of the listener (i.e., between 135° and 150° from the center of the listener) is obtained.

In an audio reproducing apparatus and method according to the present general inventive concept, a sound image can be localized at the rear of a listener using 5.1 channel speakers, and the listener can perceive a surround sound effect of a 7.1 channel sound even when the 7.1 channel sound is reproduced using the 5.1 channel speakers instead of 7.1 channel speakers. Further, a back surround filter can be implemented in real time as a finite impulse response (FIR) filter of a small order. For example, even when a 5.1 channel home theatre system plays a DVD encoded using 7.1 channels, a listener can hear a sound that seems to be reproduced through 7.1 channel speakers. Thus, both DVDs encoded using 5.1 channels and 7.1 channels can be played using an existing 5.1 channel home theatre system without need to purchase extra speakers.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An audio reproducing method, the method comprising:

separating an audio bitstream into a plurality of channel audio signals;

correcting characteristics of a first set of channel audio signals including a timing delay and an output level according to characteristics of a second set of channel audio signals;

forming virtual speakers for the second set of channel audio signals other than the first set of corrected channel audio signals at arbitrary locations using head related transfer functions measured at predetermined locations around a listener, and canceling crosstalk between the virtual speakers; and mixing the first set of corrected channel audio signals and the second set of crosstalk-cancelled channel audio signals, wherein the correcting of the characteristics of the first set of the channel audio signals comprises correcting the first set of channel audio signals using a signal correcting filter matrix given by the following equation:

$$G(z)=az^{-b}$$

where G(z) is the signal correcting filter matrix, "a" denotes a value relating to an output level of a signal, which is determined through an RMS (root mean square) power comparison between input and output signals of a back surround filter, and "b" denotes a timing delay value of a back surround filter matrix that forms the virtual speakers, which is obtained from an impulse response or phase characteristics of the back surround filter matrix that forms the virtual speakers.

2. The audio reproducing method of claim 1, wherein the first set of channel audio signals comprise a left, a right, a center, a left surround, a right surround, and a low frequency effect channel audio signals, and the correcting of the characteristics of the first set of channel audio signals comprises correcting output timings and output levels of the left channel audio signal, the right channel audio signal, the center channel audio signal, the left surround channel audio signal, the right surround channel audio signal, and the low frequency effect channel audio signal according to characteristics of virtual left and right back channel audio signals.

3. The audio reproducing method of claim 1, wherein the forming of the virtual speakers comprises:

forming the virtual speakers at the arbitrary locations by convolving a right back channel audio signal and a left back channel audio signal with the head related transfer functions measured at the predetermined locations around the listener; and canceling the crosstalk between the formed virtual speakers.

4. The audio reproducing method of claim 1, wherein the forming of the virtual speakers comprises forming the virtual speakers using a binaural synthesis filter matrix convolved with a crosstalk cancellation filter matrix to cancel the crosstalk between the virtual speakers.

5. The audio reproducing method of claim 1, wherein the forming of the virtual speakers is comprises forming the virtual speakers using the following equation:

$$\begin{bmatrix} K_{11}(z) & K_{12}(z) \\ K_{21}(z) & K_{22}(z) \end{bmatrix} = \begin{bmatrix} C_{11}(z) & C_{12}(z) \\ C_{21}(z) & C_{22}(z) \end{bmatrix} \begin{bmatrix} B_{11}(z) & B_{12}(z) \\ B_{21}(z) & B_{22}(z) \end{bmatrix}$$

where K(z) denotes a back surround filter matrix, C(z) denotes a crosstalk filter matrix, and B(z) denotes a binaural synthesis filter matrix, $B_{11}$ and $B_{21}$ of the binaural synthesis filter matrix B(z) are obtained using head related transfer functions between a speaker located between 135° and 150° on a left side of the listener and left and right ears of a dummy head, respectively, and $B_{12}$ and $B_{22}$ of the binaural synthesis filter matrix B(z) are obtained using head related transfer functions between a speaker located between 135° and 150° on a right side of the listener and left and right ears of the dummy head, respectively, and the crosstalk cancellation filter matrix C(z) is calculated according to the following equation:

$$\begin{bmatrix} C_{11}(z) & C_{12}(z) \\ C_{21}(z) & C_{22}(z) \end{bmatrix} = \begin{bmatrix} H_{11}(z) & H_{12}(z) \\ H_{21}(z) & H_{22}(z) \end{bmatrix}^{-1}$$

where $H_{11}$ and $H_{21}$ denote head related transfer functions between a speaker located between 90° and 110° on the left side of the listener and the left and right ears of the dummy head, respectively, and $H_{12}$ and $H_{22}$ denote head related transfer functions between a speaker located between 90° and 110° on the right side of the listener and the left and right ears of the dummy head, respectively.

6. The audio reproducing method of claim 1, wherein the mixing of the first set of corrected channel audio signals and the second set of crosstalk-cancelled channel audio signals comprises:

adding a corrected left surround channel audio signal to a back-surround-filtered left back channel audio signal; and adding a corrected right surround channel audio signal to a back-surround-filtered right back channel audio signal.

7. The audio reproducing method of claim 1, wherein:

a left channel audio signal, a right channel audio signal, a center channel audio signal, and a low frequency effect channel audio signal of the first set of channel audio signals are corrected according to a signal correcting filter matrix and are reproduced through a left speaker, a right speaker, a center speaker, and a subwoofer, respectively;

a left surround channel audio signal and a right surround channel audio signal of the second set of channel audio signals pass through the signal correcting filter matrix and are converted into a first left output signal and a first right output signal, respectively;

a left back channel audio signal and a right back channel audio signal of the second set of channel audio signals pass through a back surround filter matrix and are converted into a second left output signal and a second right output signal, respectively; and the first left output signal and the second left output signal are added together and output through a left surround speaker, and the first right output signal and the second right output signal are added together and output through a right surround speaker.

8. The audio reproducing method of claim 1, wherein the correcting of the characteristics of the first set of the channel audio signals includes correcting the first set of channel audio signals using a signal correcting filter matrix formed with a value of input and output signals of a back surround filter and a time delay value of a back surround filter matrix.

9. A method of an audio reproducing apparatus, the method comprising:

separating a 7.1 channel audio bitstream into eight channel audio signals;

correcting characteristics, including a timing delay and an output level, of a left channel audio signal, a right channel audio signal, a center channel audio signal, left and right surround channel audio signals, and a low frequency effect channel audio signal of the eight channel audio signals according to characteristics of left and right back channel audio signals;

forming virtual speakers for the left and right back channel audio signals at arbitrary locations using head related transfer functions measured at predetermined locations around a listener and canceling crosstalk between the virtual speakers; and adding the corrected right surround channel audio signal to the crosstalk-cancelled right back channel audio signal and adding the corrected left surround channel audio signal to the crosstalk-cancelled left back channel audio signal, wherein the correcting of the characteristics comprises correcting the left channel audio signal, the right channel audio signal, the center channel audio signal, the left and right surround channel audio signals, and the low frequency effect channel audio signal of the eight channel audio signals using a signal correcting filter matrix given by the following equation:

$$G(z)=az^{-b}$$

where G(z) is the signal correcting filter matrix, "a" denotes a value relating to an output level of a signal, which is determined through an RMS (root mean square) power comparison between input and output signals of a back surround filter, and "b" denotes a timing delay value of a back surround filter matrix that forms the virtual speakers, which is obtained from an impulse response or phase characteristics of the back surround filter matrix that forms the virtual speakers.

10. The method of claim 9, wherein the correcting of the characteristics of the left channel audio signal, the right channel audio signal, the center channel audio signal, the left and right surround channel audio signals, and the low frequency effect channel audio signal of the eight channel audio signals comprises compensating the respective signals to match an output level and a timing of the crosstalk-canceled left and right back channel audio signals.

11. The method of claim 9, wherein the forming of the virtual speakers comprises filtering the left and right back channel audio signals according to one or more head related transfer functions, and further comprising:

outputting the sum of the corrected right surround channel audio signal and the crosstalk-cancelled right back channel audio signal to a right surround speaker and outputting the sum of the corrected left surround channel audio signal and the crosstalk-cancelled left back channel audio signal to a left surround speaker.

12. The method of claim 11, wherein a sound image of the left and right back channel audio signals cause a listener to perceive that the left and right back channel audio signals originate from the virtual speakers.

13. The method of claim 11, wherein the filtering of the left and right back channel audio signals according to one or more head transfer functions comprises:

determining a first and a second head related transfer function of a right ear and a left ear, respectively, for a speaker positioned at a first predetermined speaker location for a first virtual speaker;

determining a third and a fourth head related transfer function of the right ear and the left ear, respectively, for a speaker positioned at a second predetermined speaker location for a second virtual speaker; and filtering the left and right back channel audio signals according to the first, second, third, and fourth head related transfer functions.

14. The method of claim 13, wherein the filtering of the left and right back channel audio signals according to one or more head transfer functions further comprises:

determining a fifth, a sixth, a seventh, and an eighth head related transfer function of the right and the left ear for a speaker positioned at each of the right surround speaker and the left surround speaker.

15. The method of claim 14, wherein the canceling of the crosstalk between the virtual speakers comprises:

filtering the left and right back channel audio signals according to inverses of the fifth, the sixth, the seventh, and the eighth head related transfer functions to cancel crosstalk between the first virtual speaker and the second virtual speaker.

16. The method of claim 9, wherein the canceling of the crosstalk between the virtual speakers comprises processing the left and right back channel audio signals so that the left and right back channel audio signals are each heard in a single ear.

17. The method of claim 9, wherein the virtual speakers comprise back virtual speakers among front actual speakers and side actual speakers in a plurality of actual speakers.

18. An audio reproducing apparatus, comprising:

a decoder to separate a 7.1 channel audio bitstream into eight channel audio signals;

a signal corrector to correct characteristics, including a timing delay and an output level, of a left channel audio signal, a right channel audio signal, a center channel audio signal, left and right surround channel audio signals, and a low frequency effect channel audio signal of the eight channel audio signals according to characteristics of left and right back channel audio signals;

a back surround filter to form virtual speakers for the left and right back channel audio signals at arbitrary locations using head related transfer functions measured at predetermined locations around a listener and to cancel crosstalk between the virtual speakers; and an adder to add the right surround channel audio signal output by the signal corrector to the right back channel audio signal output by the back surround filter and to add the left surround channel audio signal output by the signal corrector to the left back channel audio signal output by the back surround filter, wherein the signal corrector corrects the left channel audio signal, the right channel audio signal, the center channel audio signal, the left and right surround channel audio signals, and the low frequency effect channel audio signal of the eight channel audio signals using a signal correcting filter matrix given by the following equation:

$$G(z)=az^{-b}$$

where G(z) is the signal correcting filter matrix, "a" denotes a value relating to an output level of a signal, which is determined through an RMS (root mean square) power comparison between input and output signals of a back surround filter, and "b" denotes a timing delay value of the back surround filter matrix that forms the virtual speakers, which is obtained from an impulse response or phase characteristics of the back surround filter matrix that forms the virtual speakers.

19. The audio reproducing apparatus of claim 18, wherein the back surround filter comprises:

a binaural synthesizer to form the virtual speakers at the arbitrary locations by convolving the right and left back channel audio signals with the head related transfer functions measured at the predetermined locations around the listener; and a crosstalk canceller to cancel the crosstalk between the virtual speakers formed by the binaural synthesizer.

20. The audio reproducing apparatus of claim 19, wherein the binaural synthesizer comprises:

a unit to calculate head related transfer functions between a speaker located between a first angle and a second angle on a left side of the listener and a left and right ears of a dummy head, respectively, and head related transfer functions between a speaker located between the first angle and the second angle on a right side of the listener and the left and right ears of the dummy head, respectively; and a unit to form a first virtual channel signal by adding a value of a convolution of the left back channel signal with the head related transfer function to a value of a convolution of the right back channel signal with the head related transfer function and a second virtual channel signal by adding a value of a convolution of the left back channel signal with the head related transfer function to a value of a convolution of the right back channel signal with the head related transfer function.

21. The audio reproducing apparatus of claim 20, wherein the first angle is 135 degrees, and the second angle is 150 degrees.

22. The apparatus according to claim 19, wherein the binaural synthesizer comprises:

a first convolution unit to convolve the right back channel audio signal with the first head related transfer function;

a second convolution unit to convolve the left back channel audio signal with the second head related transfer function;

a third convolution unit to convolve the right back channel audio signal with the third head related transfer function;

a fourth convolution unit to convolve the left back channel audio signal with the fourth head related transfer function;

a first adder to determine a first sum of the first and second convolutions and to provide the first sum to the crosstalk canceller; and a second adder to determine a second sum of the third and fourth convolutions and to provide the second sum to the crosstalk canceller.

23. The apparatus of claim 19, wherein the crosstalk canceller comprises:

a fifth convolution unit to convolve the first sum with an inverse of the fifth head related transfer function;

a sixth convolution unit to convolve the second sum with an inverse of the sixth head related transfer function;

a seventh convolution unit to convolve the first sum with an inverse of the seventh head related transfer function;

a eighth convolution unit to convolve the second sum with an inverse of the eighth head related transfer function;

a third adder to determine a third sum of the fifth and sixth convolutions and to provide the third sum as an output to the left surround speaker; and a fourth adder to determine a fourth sum of the seventh and eighth convolutions and to provide the fourth sum as an output to the right surround speaker.

24. An audio reproducing system to reproduce a sound of 7.1 channels through 5.1 channel speakers, the system comprising:

a back surround filter to form a virtual speaker for a left back channel and a right back channel of the 7.1 channels;

a correction filter to correct an output timing and an output level of each of the 7.1 channels except for the left back channel and the right back channel; and an adder to add the left back channel output by the back surround filter to a left surround channel output by the correction filter and to add the right back channel output by the back surround filter to a right surround channel output by the correction filter, wherein the back surround filter is obtained using the following equation:

$$\begin{bmatrix} K_{11}(z) & K_{12}(z) \\ K_{21}(z) & K_{22}(z) \end{bmatrix} = \begin{bmatrix} C_{11}(z) & C_{12}(z) \\ C_{21}(z) & C_{22}(z) \end{bmatrix} \begin{bmatrix} B_{11}(z) & B_{12}(z) \\ B_{21}(z) & B_{22}(z) \end{bmatrix}$$

where K(z) denotes a back surround filter matrix, C(z) denotes a crosstalk filter matrix, and B(z) denotes a binaural synthesis filter matrix, $B_{11}$ and $B_{21}$ of the binaural synthesis filter matrix B(z) are obtained using head related transfer functions between a speaker located between a first angle and a second angle on a left side of a listener and left and right ears of a dummy head, respectively, and $B_{12}$ and $B_{22}$ of the binaural synthesis filter matrix B(z) are obtained using head related transfer functions between a speaker located between the first angle and the second angle on a right side of the listener and the left and right ears of the dummy head, respectively, and the crosstalk cancellation filter matrix C(z) is calculated using the following equation:

$$\begin{bmatrix} C_{11}(z) & C_{12}(z) \\ C_{21}(z) & C_{22}(z) \end{bmatrix} = \begin{bmatrix} H_{11}(z) & H_{12}(z) \\ H_{21}(z) & H_{22}(z) \end{bmatrix}^{-1}$$

where $H_{11}$ and $H_{21}$ denote head related transfer functions between a speaker located between a third angle and a fourth angle on the left side of the listener and the left and right ears of the dummy head, respectively, and $H_{12}$ and $H_{22}$ denote head related transfer functions between a speaker located between the third angle and the fourth angle on the right side of the listener and the left and right ears of the dummy head, respectively.

25. The system of claim 24, wherein the first angle is 135 degrees and the second angle is 150 degrees.

26. The system of claim 24, wherein the third angle is 90 degrees and the fourth angle is 110 degrees.

* * * * *